US006796830B2

(12) United States Patent
Süss et al.

(10) Patent No.: US 6,796,830 B2
(45) Date of Patent: Sep. 28, 2004

(54) SCREWLESS CONNECTING TERMINAL

(75) Inventors: Christian Süss, Strullendorf (DE); Heinz Ungermann, Linsengericht (DE)

(73) Assignee: Wieland Electric GmbH, Bamberg (DE)

( * ) Notice: Subject to any disclaimer, the term of this patent is extended or adjusted under 35 U.S.C. 154(b) by 0 days.

(21) Appl. No.: 10/127,668

(22) Filed: Apr. 22, 2002

(65) Prior Publication Data

US 2002/0155749 A1 Oct. 24, 2002

(30) Foreign Application Priority Data

Apr. 20, 2001 (DE) ..... 101 19 652

(51) Int. Cl.[7] ..... H01R 11/20
(52) U.S. Cl. ..... 439/409; 439/395
(58) Field of Search ..... 439/409, 391, 439/389, 387, 417, 443, 406, 407, 395, 396, 397, 398, 399, 400, 401, 402, 403, 404, 405, 408

(56) References Cited

U.S. PATENT DOCUMENTS

| | | | | | |
|---|---|---|---|---|---|
| 3,634,818 | A | * | 1/1972 | Horecky | 439/851 |
| 5,620,332 | A | * | 4/1997 | Gerke et al. | 439/417 |
| 5,624,273 | A | | 4/1997 | Myer | |
| 5,816,843 | A | * | 10/1998 | Gerberding | 439/410 |
| 5,879,181 | A | * | 3/1999 | Okabe | 439/397 |
| 6,033,255 | A | * | 3/2000 | Murofushi | 439/397 |
| 6,120,316 | A | * | 9/2000 | Allgaier et al. | 439/404 |
| 6,361,352 | B2 | * | 3/2002 | Barrat et al. | 439/395 |
| 6,468,103 | B1 | * | 10/2002 | Brower | 439/417 |
| 6,527,580 | B1 | * | 3/2003 | Suss et al. | 439/417 |

FOREIGN PATENT DOCUMENTS

| | | |
|---|---|---|
| EP | 0 063 206 A2 | 10/1982 |
| EP | 0 063 206 | 10/1982 |
| EP | 0 851 534 A2 | 7/1998 |
| JP | 10 134 861 A | 5/1998 |
| WO | 00/70714 | 11/2000 |

OTHER PUBLICATIONS

Alfred Böge: "Formeln und Tabellen zur Mechanik und Festigkeitslehre" [formulas and tables for mechanics and strength], *Viewegs Fachbücher der Technik, p. 29.*
Dubbel: "Taschenbuch für den Maschinenbau" [pocket book for mechanical engineering], *Springer Verlag, Berlin,* 1974, vol. 1, pp. 378–379, 426–427.

* cited by examiner

*Primary Examiner*—Gary Paumen
*Assistant Examiner*—Edwin A. Leon
(74) *Attorney, Agent, or Firm*—Laurence A. Greenberg; Werner H. Stemer; Ralph E. Locher

(57) ABSTRACT

A screwless connecting terminal, in particular a modular terminal, is described. The terminal has a conductor rail situated in a terminal housing, an insulation-piercing connection connected in an electrically conductive fashion with the conductor rail, and between whose cutting edges, which face one another, an electrical conductor can be contacted that can be introduced into the terminal housing via a housing lead-through. An insulation-piercing contacting of the immovably positioned conductor takes place through a translational movement of the insulation-piercing connection along the conductor rail in a longitudinal direction of the rail. At least one bead is formed in at least one clamp limb of the insulation-piercing connection.

9 Claims, 6 Drawing Sheets

SCREWLESS CONNECTING TERMINAL

BACKGROUND OF THE INVENTION

Field of the Invention

The invention relates to a screwless connecting terminal, in particular a modular terminal. The terminal has a conductor rail situated in a terminal housing, and an insulation-piercing connection that is connected in an electrically conductive fashion with the conductor rail. Between cutting edges, facing one another, an electrical conductor can be contacted when it is introduced into the terminal housing through a lead-through in the housing.

Connecting terminals for the contacting and connection of electrical conductors are also known in many embodiments as what are called modular terminals, which can be snapped onto supporting rails or top-hat rails. Here a distinction can be made between screw terminals, in which the electrical conductors are fastened by clamping screws, and screwless connecting terminals in the form of spring clips, in which the electrical conductors are clamp-contacted using a pressure spring or a tension spring. While in the case of the cited screw terminals and spring clips the conductor end to be contacted is stripped of insulation beforehand. What are commonly known as insulation-piercing connections enable a conductor contacting without the stripping of the insulation. Here, screwless connecting terminals are generally used for conductor contacting without the stripping of the insulation.

A connecting terminal of this sort is known for example from International Patent Disclosure WO 00/70714 of the instant applicant, having the title "Screwless Connecting Terminal", dated May 9th, 2000. The known connecting terminal has similarities with the subject matter of the instant invention in its configuration and function, and reference is made to the disclosure of WO 00/70714. In the connecting terminal, which uses insulation-piercing technology, an insulation-piercing connection is provided that is connected with a conductor rail. The essentially U-shaped insulation-piercing connection has two clamp limbs that are bent towards one another, forming the limbs of the U. For the application of the required spring force for the insulation-piercing connection, the clamp limbs must have a relatively large wall thickness, so that the insulation-piercing connection can turn out to be of fairly broad construction.

SUMMARY OF THE INVENTION

It is accordingly an object of the invention to provide a screwless connecting terminal that overcomes the above-mentioned disadvantages of the prior art devices of this general type, which has an insulation-piercing connection built in as space-saving a manner as possible.

With the foregoing and other objects in view there is provided, in accordance with the invention, a screwless connecting terminal. The screwless connecting terminal containing a terminal housing having a housing lead-through formed therein, a conductor rail disposed in the terminal housing, and an insulation-piercing connection connected in an electrically conductive fashion with the conductor rail. The insulation-piercing connection has clamp limbs with cutting edges facing one another for receiving and contacting an electrical conductor introduced into the terminal housing through the housing lead-through. An insulation-piercing contacting of the electrical conductor immovably positioned in the terminal housing takes place through a translational movement of the insulation-piercing connection along the conductor rail in a longitudinal direction of the conductor rail. At least one bead is formed in at least one of said clamp limbs.

In order to achieve the object, it is inventively provided to form one or more beads into at least one of the two clamp limbs.

An advantage of the invention is that it is possible to use a relatively thin-walled insulation-piercing connection. Through the exact placement of the bead, it can be ensured that the cross-sectional reinforcement effected by the installation of the bead is located exactly at the point at which, when the conductor is connected, a spring force of the clamp limbs is also actually required, when the conductor is introduced into the connecting terminal. In this way, the insulation-piercing connection is purposively strengthened exactly at the point at which, when the conductor is connected, high spring forces are also actually required. The remaining regions of the insulation-piercing connection can in this way be realized so as to save space and material, and thus with a narrow construction. Moreover, the use of material as such is reduced.

Due to the symmetry of the U-shaped insulation-piercing connection, it is particularly advantageous also to select an essentially U-shaped bead shape, i.e., one that is symmetrical with respect to the center longitudinal axis of the connecting terminal.

In a preferred exemplary embodiment of the invention, three beads are situated next to one another along the center longitudinal axis of the insulation-piercing connection.

In order to form the cutting edges, the insulation-piercing connection is realized with a U-shape, the free ends of the U-limbs being bent towards one another in order to create the cutting and guide slot. A front edge of the insulation-piercing connection, i.e., the cutting slot, which faces the conductor when the conductor is introduced into the terminal housing, is here realized so that it has a beveling that runs downward, with a scarfing.

The conductor, which is advantageously rigid, and is thus positioned in an immovable fashion in the terminal housing, is held in a sleeve-type guide element after being introduced into the terminal housing and before the actual insulation-piercing contacting. The guide element being formed above the cutting edges by the housing lead-through and under the cutting edges by guide clips that are integrally formed onto the insulation-piercing connection and that extend in the longitudinal direction of the rail. The clips are adjacent to the conductor before the insulation-piercing contacting, and thus hold the conductor between them.

The electrically conductive connection between the insulation-piercing connection and the conductor rail can take place in various ways. In a particularly preferred specific embodiment, the connection takes place by a sliding clip that is integrally formed onto a front edge of the insulation-piercing connection, underneath the front edge, and that extends in the longitudinal direction of the rail. The sliding clip is bent against a bent-in conductor rail segment in such a way that it is adjacent to the underside of the conductor rail segment. In a useful development of the specific embodiment, the bent-in conductor rail segment has a free end that is placed in the direction of the housing lead-through. The free end acts as a bearing web at the back side of the conductor, i.e., at the side facing away from the insulation-piercing connection.

According to an alternative specific embodiment, the electrically conductive connection between the insulation-piercing connection and the conductor rail takes place by a lateral sliding contact. Here, the insulation-piercing connection preferably has two sliding clips that are adjacent to the opposed side edges of the conductor rail. In this specific embodiment, the conductor rail is usefully fashioned so as to be waisted in the sliding contact region, so that the sliding clips, which are preferably curved inward in the direction towards the conductor rail, do not protrude past the conductor rail laterally, or do so only insignificantly.

In a further specific embodiment, the electrically conductive connection takes place by a sliding contact that is lower and/or upper in relation to the conductor rail. Here, a sliding clip that is integrally formed on the insulation-piercing connection is adjacent to the underside of the conductor rail, to the upper side of the conductor rail, or to both sides of the conductor rail. For this purpose, the sliding clip integrally formed on the insulation-piercing connection is bent transverse to the longitudinal direction of the rail. For the contacting at the upper and undersides, the sliding clip is bent around from the underside of the conductor rail to the upper side thereof, and is thereby situated adjacent to the upper side of the conductor rail at its free end, so as to surround the conductor rail.

In addition, the electrically conductive connection between the insulation-piercing connection and the conductor rail can take place by a sliding contact provided in the center region of the conductor rail. For this purpose, a contact clip integrally formed on the conductor rail has a sliding clip placed adjacent to it, the sliding clip being in turn integrally formed on the insulation-piercing connection. Useful, in this specific embodiment, are two sliding clips holding the contact clip of the conductor rail between them, and are integrally formed on the insulation-piercing connection. The sliding clips are bent in the direction towards the center of the conductor rail, and are situated adjacent to the positioned contact clip of the conductor rail.

For the formation of the contact clip, a broadened conductor rail segment can be slotted at both ends transverse to the longitudinal direction of the conductor rail, and can be subsequently bent upward. Alternatively, for the formation of the contact clip a conductor rail segment positioned through multiple bending can be oriented parallel to the longitudinal direction of the conductor rail through subsequent twisting or rotation.

In connecting terminals of this sort in insulation-piercing technology, the insulation of the conductor is cut for the contacting thereof. In order to apply the force required for this, in general an actuating tool is provided that can be introduced into the housing of the connecting terminal from outside, for example a screwdriver, with which the conductor and the insulation-piercing connection can be moved relative to one another. For this reason, the insulation-piercing connection usefully has, situated one after the other in the direction of motion, an introduction opening or an introduction slot for the conductor and a contact cavity for an actuating tool. A funnel-shaped housing shaft in the terminal housing, via which an actuating tool can be introduced into the terminal housing from the outside, is aligned with the contact cavity, which is fashioned for example with a dovetail shape. The funnel-shaped housing shaft tapers in the direction of introduction, and then widens conically in the direction of introduction underneath the narrowing or constriction formed thereby.

In order to enable a handling that is as protective as possible, in a particularly useful construction, for the contacting of the conductor a contacting element is actuated via an actuation element that works together with the actuating tool. The actuating element being fashioned such that an immediate contact between the actuating tool and the contacting element is avoided. Here, for a reliable insulation-piercing contacting, it is provided that the contacting element surrounds the insulation-piercing connection for the contacting of the conductor, which is held stationary in the terminal housing. In this way, the contacting element and the insulation-piercing connection form a uniform component.

This embodiment, with the additional actuating element, has the advantage that the contacting element cannot be damaged as a result of, for example, an improper introduction of the actuating tool. This ensures a protective actuation, so that the functional capacity of the insulation-piercing connection is maintained even given repeated conductor contacting. Preferably, for this purpose, when an actuating tool is introduced the actuating element is situated between the tool and the contacting element.

The actuating element, which has a receiving chamber for the actuating tool, is constructed so as to be hollow on the inside, and forms a many-sided guide for the actuating tool. In this way, both during the contacting and also during the detaching of the contact, i.e. given different directions of motion of the actuating tool, a direct contact is avoided between the actuating tool and the contacting element. Here, the actuating element preferably engages loosely with the contacting element. The loose engaging enables on the one hand a reliable guiding of the actuating tool, while on the other hand a simple handling is ensured due to the play. Here, the actuating element is preferably situated in the terminal housing so that it cannot be lost, in order to avoid a loss of the actuating element.

In a useful development, the housing has a projection as an abutment for the actuating element, and the actuating element is snapped into the abutment. This enables a particularly simple attachment of the actuating element in the terminal housing, by pressing the actuating element into the terminal housing via a pressure point determined by the projection. Here, the projection can determine an axis of rotation for the actuating element. Because the actuating element simultaneously guides the actuating tool, this tool is likewise rotated about the axis of rotation. The projection, fashioned as an abutment, thus forms a point of application on which the actuating tool is supported. In this way, the forces exerted by the actuating tool are advantageously received by the terminal housing.

If the actuating element is fashioned as a pivoting lever, having an in particular wedge-shaped convexity as a counter-support to the abutment, a simple introduction of the actuating element into the terminal housing is enabled. In order to ensure a simple introduction past the projection, the actuating element is preferably fashioned elastically. For a simple construction from a manufacturing point of view, the actuating element is preferably of one-piece construction.

In order to obtain a high degree of user-friendliness of the connecting terminal, the actuating element usefully has a display indicating the direction of motion, into the open position or into the clamped position. In this way, it can easily be seen from outside in which direction the actuating tool must be guided for the clamped contacting or for the detaching of the contact. Also in order to ensure user-friendliness, and in order to recognize whether the plug-in conductor is contacted, in a preferred construction the actuating element has a marking for the position of the contacting element.

In a further preferred specific embodiment, the beads taper upwards in the direction towards the cutting edges. The bead thickness or depth thus decreases from the base of the U of the insulation-piercing connection towards the cutting edges. Thus, the bead stands out strongly in the vicinity of the base of the U, and is beveled upward in the direction towards the cutting edges, to the outer wall of the clamp limbs. As a result, the clamp limbs behave in the manner of a spring bar having uniform bending stress, as is known for example from reference Viewegs B Fachbücher der Technik, by Alfred Bögel, Formeln und Tabellen zur Mechanik und Festigkeitslehre, p. 29, ch. 4.15, "Träger gleicher Biegebeanspruchung," as well as Dubbel, Taschenbuch für den Maschinenbau, 13th ed., reprinted 1974, p. 376, chapter: "Träger gleicher Biegebeanspruchung."

In accordance with a concomitant feature of the invention, the bead is convexly curved outward or alternatively the bead is concavely curved inward.

Other features which are considered as characteristic for the invention are set forth in the appended claims.

Although the invention is illustrated and described herein as embodied in a screwless connecting terminal, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
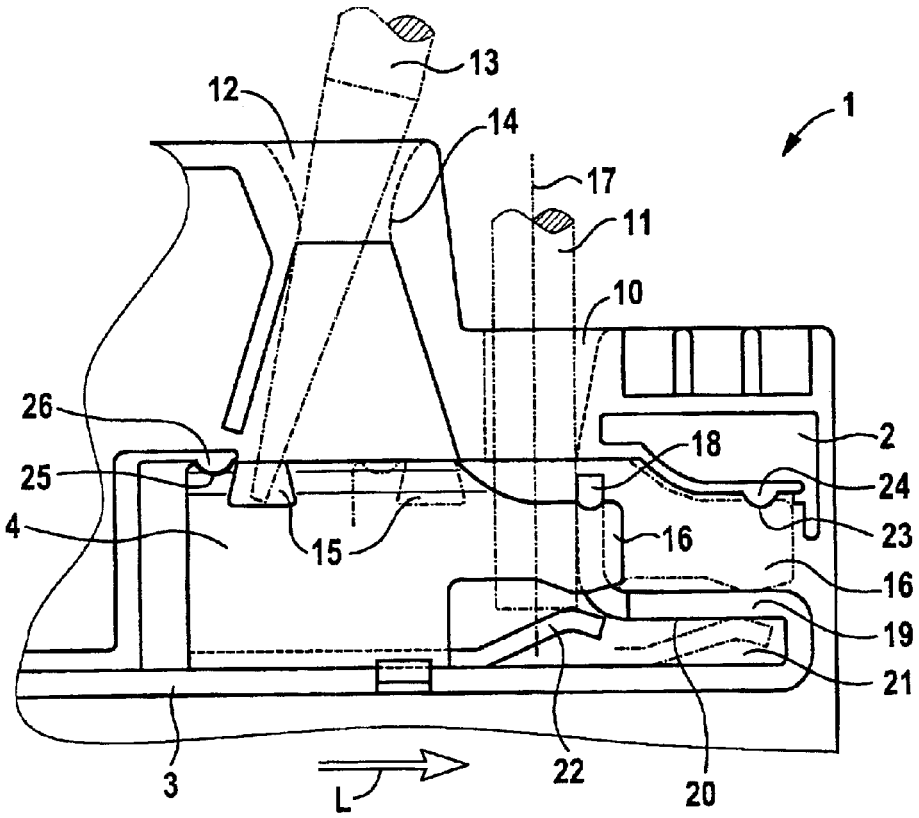
FIG. 1 is a diagrammatic, partial, simplified, side-elevational view without beads, of a screwless connecting terminal having an insulation-piercing connection that can be displaced in a translational fashion along a conductor rail according to the invention.

In all the figures of the drawing, sub-features and integral parts that correspond to one another bear the same reference symbol in each case. Referring now to the figures of the drawing in detail and first, particularly, to FIGS. 1–3 thereof, there is shown a simplified view of a screwless connecting terminal 1 in a side view, front view, and top view, for the explanation of functional parts. The connecting terminal 1, shown in sections, is preferably realized as what is known as a modular terminal, and for this purpose includes a terminal housing 2, of which only what is known as a shell, provided with inner contours, is shown. The connecting terminal 1 additionally includes, inside the terminal housing 2, a conductor rail 3 disposed in a stationary fashion, and an insulation-piercing connection 4 situated in a movable fashion thereon. The insulation-piercing connection 4 is fashioned in the shape of a U (FIG. 2), and has on its clamp limbs 5, 6, which are bent towards one another at the free ends, knife-type cutting edges 7 or 8, between which a cutting and guide slot 9 is formed for the insulation-cutting contacting of a conductor 11, which is introduced into the terminal housing 2 through a housing lead-through 10 (FIG. 1).

In a longitudinal direction L of the conductor rail 3, which is at the same time the direction of displacement or motion of the insulation-piercing connection 4 along the conductor rail 3, an additional feed-through opening 12 is provided in the terminal housing 2 in front of the feed-through opening 10, via which additional opening an actuating tool 13, for example a screwdriver 13, can be introduced into the terminal housing 2. The feed-through opening 12 is realized as a funnel-shaped housing shaft 12, which tapers in conical fashion to form a constriction 14 of the funnel-shaped housing shaft 12, and from there broadens, again in conical fashion, in the direction towards the insulation-piercing connection 4. A dovetail-shaped contact cavity 15, made in the insulation-piercing connection 4 in a region of the cutting edges 7, 8 thereof, is aligned with the funnel-shaped housing shaft 12. The actuating tool 13 engages in the contact cavity 15 in order to displace the insulation-piercing connection 4 relative to the stationary conductor rail 3, from the position shown into the position indicated in broken lines. Here, the actuating tool 13 is supported in the manner of a lever on a narrowing or constriction 14.

In the position shown, the conductor 11, introduced into the terminal housing 2, is fixed in its position and is held immovable. For this purpose, on the one hand the wall of housing lead-through 10 is used, and on the other hand a support of the conductor 11 in a region between the conductor rail 3 and cutting edges 7, 8 of the insulation-piercing connection 4 is used. For this purpose, guide clips 16 (of which only one is visible), extending in the direction of the housing lead-through 10, are integrally formed thereon. The guide clips 16 flank a conductor end of the conductor 11, and thus form the lateral support for it. An additional backwards support inside the terminal housing 2, in the rail longitudinal direction L behind the housing lead-through 10, forms a free end 18, positioned parallel to direction of introduction of the conductor 11, of an inwardly bent conductor rail segment 19.

A sliding contact chamber 21 is formed underneath an underside 20 of conductor rail segment 19. In the sliding contact chamber 21 there is a sliding clip 22 that is integrally formed on the underside, situated opposite the cutting edges 7 and 8, of the insulation-piercing connection 4, and is positioned in a direction of the feed-through opening 10. As the broken line guide indicates, as a result of a translational displacement of the insulation-piercing connection 4 from the depicted uncontacted functional position into the contacting functional position (shown in broken lines), the sliding clip 22 is situated adjacent to the underside of the bent-in conductor rail segment 19. In this way, the electrically conductive connection is produced between the insulation-piercing connection 4 and the conductor rail 3.

The insulation-piercing connection 4 is locked in this contacting functional position, in which the cutting edges 7 and 8 penetrate the insulation of the conductor 11 and contact the leads thereof. For this purpose, a locking groove 23 is provided on the clamp clip 16, or on each such clip, into which groove a locking hook 24, integrally formed on the inner contour of the terminal housing 2, snaps in a resilient, spring-loaded fashion. A further snap connection, which locks into place in the shown open position, is also provided on the backside, situated opposite guide clips 16, of the insulation-piercing connection 4. For this purpose, in the region of the upper side thereof a locking groove 25 is in turn formed therein, into which a likewise springy locking hook 26 snaps in.

Figure 4:
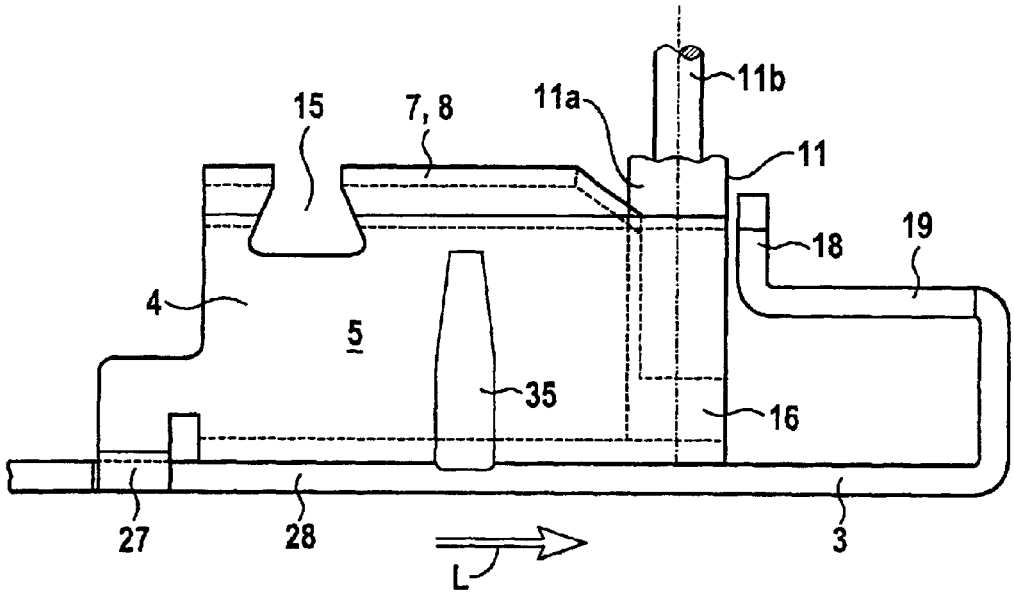
FIGS. 4 and 5 are side-elevational views of functional parts of a specific embodiment of the connecting terminal having a bead on a contact element, with a lateral sliding contacting between the insulation-piercing connection and the conductor rail, in the uncontacted, or contacted, functional position.
Figure 5:
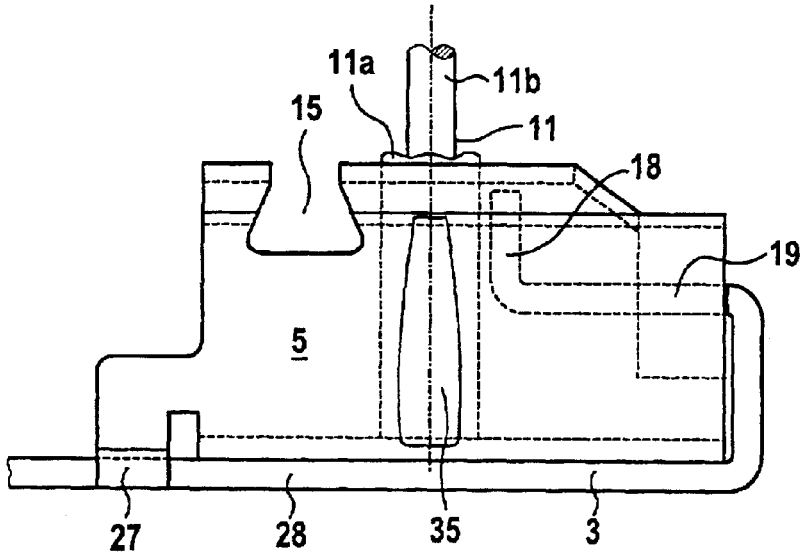

A first specific embodiment of the screwless connecting terminal 1 according to the invention is shown in FIGS. 4 and 5 in the uncontacted or contacted functional position. Only the functional element of the connecting terminal 1, formed in turn from the conductor rail 3 and the insulation-piercing connection 4, is shown, for the insulation-piercing contacting of the conductor 11. In the specific embodiment of the connecting terminal 1 as well, in an analogous manner the insulation-piercing connection 4 is displaced in a translational fashion in the direction L of the conductor rail 3, and thus in the direction towards the conductor 11, which is held in immovable and stationary fashion inside the terminal housing 2. The insulation-piercing contacting in turn takes place as a result of a cutting of a conductor insulation 11*a* by the cutting edges 7 and 8 of the insulation-piercing connection 4, until the contacting thereof with conductor leads 11*b* takes place.

A bead 35, formed into the clamp limb 5, can be seen clearly in FIG. 4 and FIG. 5. The bead 35 reinforces the clamp limb 5, which can be seen clearly in particular in FIG. 5, precisely in the region that coincides with the electrical conductor 11 in its final contacting position, shown in FIG. 5.

Figure 2:
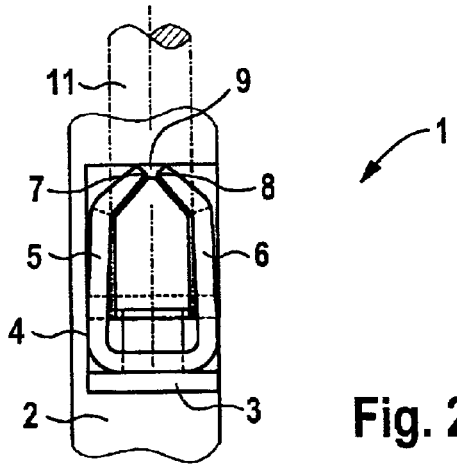
FIG. 2 is a front-elevational view of the connecting terminal.
Figure 3:
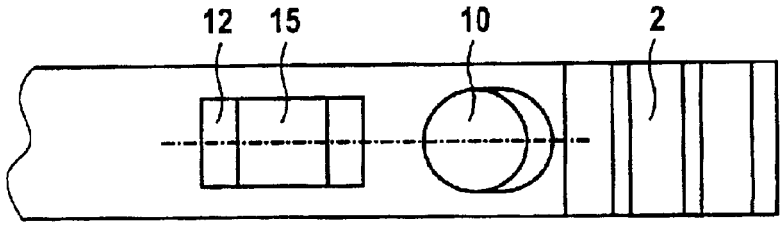
FIG. 3 is a top view of the connecting terminal.
Figure 6:
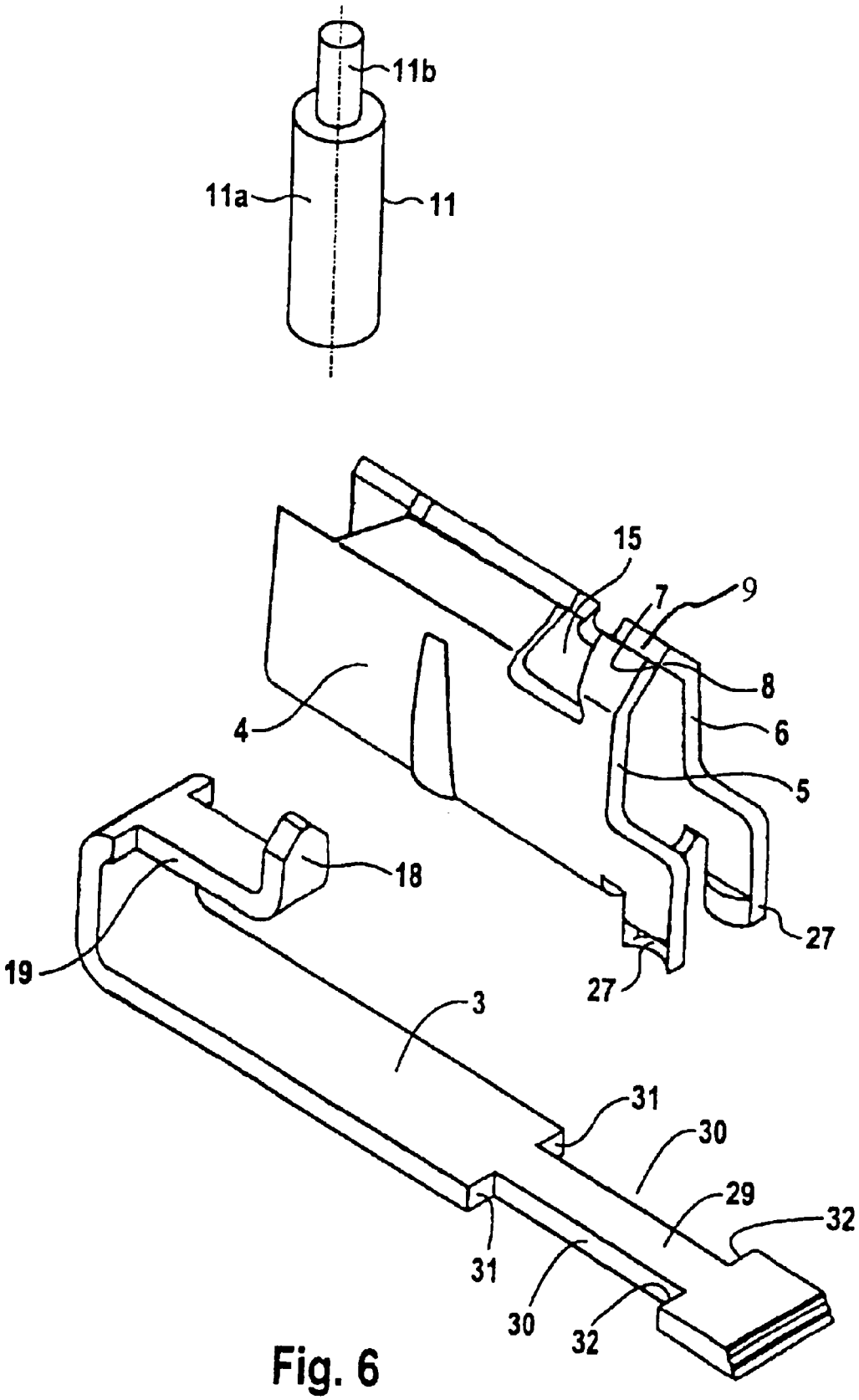
FIG. 6 is an exploded, perspective view of the functional parts of the connecting terminal according to FIGS. 4 and 5.

Differing from the specific embodiment according to FIGS. 1 to 3, the electrically conductive connection between the insulation-piercing connection 4 and the conductor rail 3 takes place by a lateral sliding contact. This is realized through sliding clips 27 that are integrally formed on the insulation-piercing connection 4. The clips 27 being situated adjacent to opposed side edges 28 of the conductor rail 3. This can be seen comparatively clearly from the exploded view, shown in FIG. 6, of this functional element. For this purpose, the inwardly curved sliding clips 27 of the conductor rail 4 enclose between them a conductor rail region 29, which is constructed in waisted fashion and is formed by recesses 30 on both sides of the conductor rail 3. The recesses 30 thus simultaneously form stop edges 31 and 32 in the contacting, or uncontacting, functional position of the insulation-piercing connection 4, which can be translationally displaced on the conductor rail 3.

Figure 7:
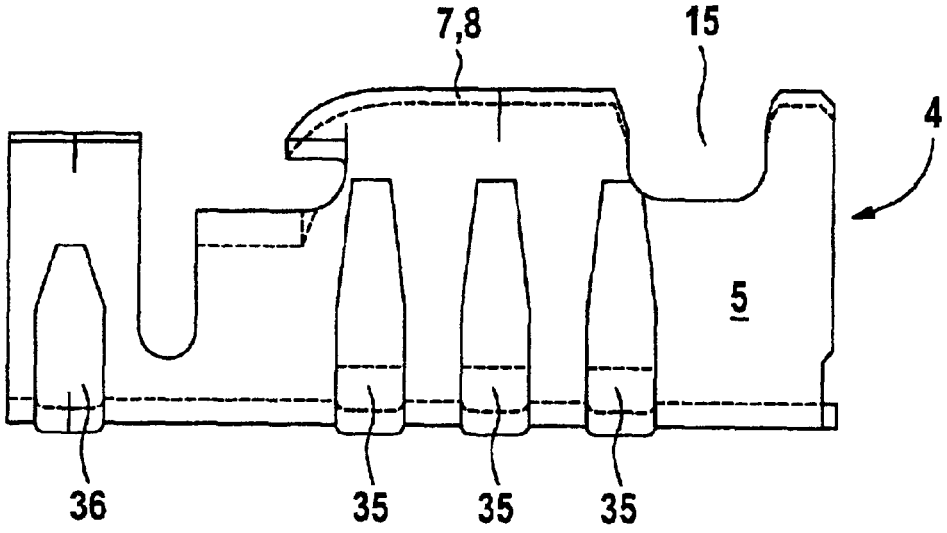
FIG. 7 is a side-elevational view of a specific embodiment of the insulation-piercing connection having three beads.
Figure 8:
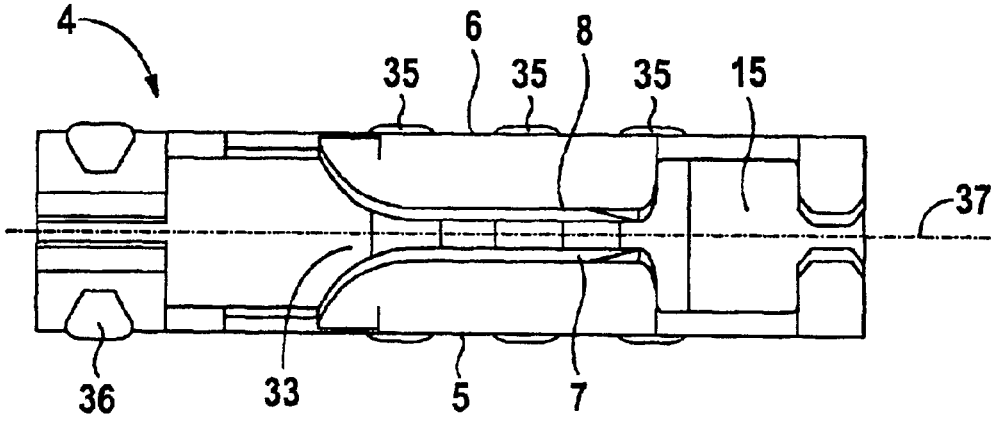
FIG. 8 is a plan view of a specific embodiment of the insulation-piercing connection having the three beads.
Figure 9:
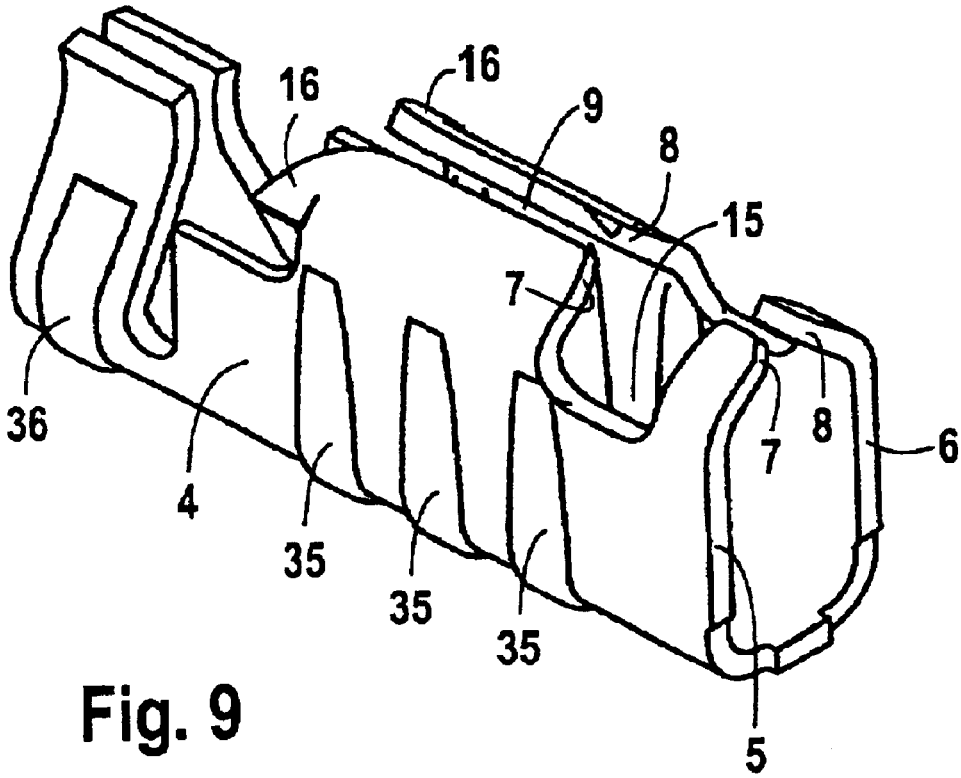
FIG. 9 is a perspective view of the insulation-piercing connection according to FIGS. 7 and 8.

FIG. 7 shows, as do FIGS. 8 and 9, a preferred specific embodiment of the insulation cutting connection 4, having three beads 35 situated alongside one another in the direction of a center longitudinal axis 37. The beads 35 are formed into the clamp limbs 5, 6 in a circumferential fashion, and thus form U-shaped reinforcing beads. Through the placement of the three beads 35 one after the other, the overall region of the insulation-piercing connection 4 is reinforced that comes into contact with electrical conductor 11 of the insulation-piercing contacting. The figures also illustrate the possibility of providing additional beads 36 in other regions on the insulation-piercing connection 4, for the reinforcement of additional regions of insulation-piercing connection 4.

The beads 35 result in an increase in the spring force of the U-shaped insulation-piercing connection 4, with the result that the clamp limbs 5, 6, or the cutting edges 7, 8, are not spread as far apart by the electrical conductor 11 as is the case in a specific embodiment having the same wall thickness without the beads 35.

Figure 10:
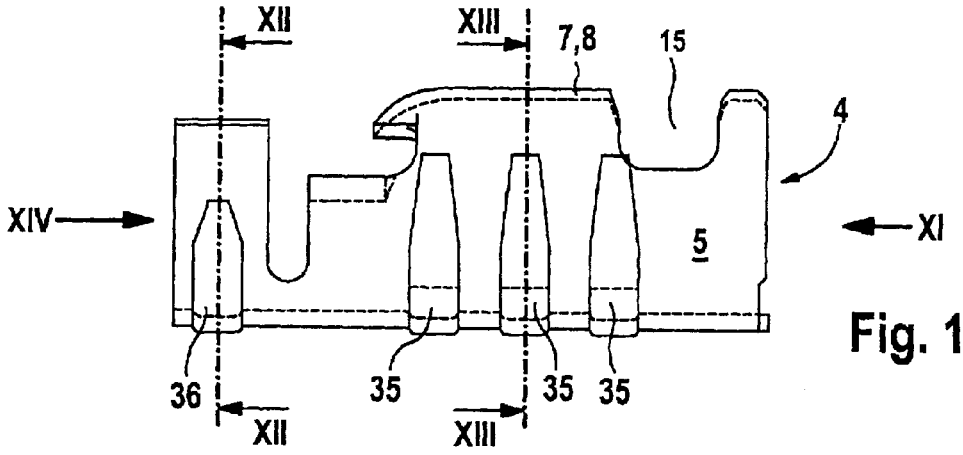
FIG. 10 is a side-elevational view of the insulation-piercing connection from the same side as is shown in FIG. 7.

FIG. 10 shows the same side view of the insulation-piercing connection 4 as does FIG. 7, but with two sections XII—XII, XIII—XIII. In the following, the beads 35, tapering in the direction towards the cutting edges 7, 8, and the concomitant decreasing effective wall thickness $W_S$ of the insulation-piercing connection 4, are described.

Figure 11:
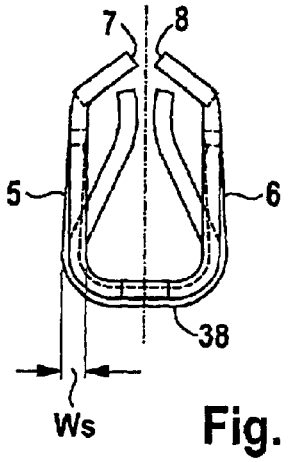
FIG. 11 is a plan view of a front end face of the insulation-piercing connection according to FIG. 10.

FIG. 11 shows a top view of the front end face of the insulation-piercing connection 4. Here, the clamp limbs 5, 6 are shown in a partially transparent fashion. In this way, the effective wall thickness $W_S$ of the insulation-piercing connection 4 can be depicted. Here, the effective wall thickness $W_S$ at the bead 35 in the region of a base 38 of the U of insulation-piercing connection 4 is shown. In contrast, the effective wall thickness in the upper region of clamp limbs 5, 6 is significantly less, because a bead depth $T_S$ decreases as it moves upward.

Figure 12:
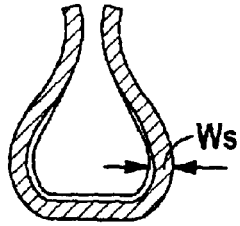
FIG. 12 is a sectional view taken along the line XII—XII in FIG. 10.

FIG. 12 shows a sectional view along the line XII—XII in FIG. 10. Here again, the effective wall thickness $W_S$ is shown, here in the region of the bead 36. Because the bead 36 also tapers towards the top, the effective wall thickness $W_S$ in turn correspondingly decreases.

Figure 13:
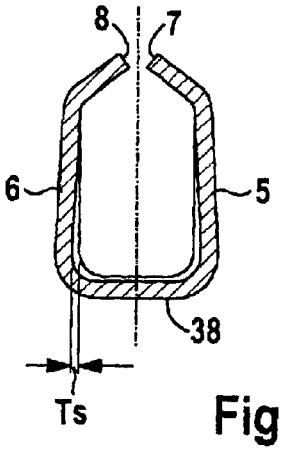
FIG. 13 is a sectional view taken along the line XIII—XIII in FIG. 10.

FIG. 13 shows a sectional view taken along the line XIII—XIII in FIG. 10. It can be seen that in the exemplary embodiment shown in FIG. 10, each of the beads 35 runs out upward in the direction towards the cutting edges 7, 8; i.e., bead depth $T_S$ decreases from the base 38 of the U of insulation-piercing connection 4 towards the cutting edges 7, 8. As a result, the bead 35 stands out strongly in the vicinity of the base 38 of the U, and is beveled upward in the direction towards the cutting edges 7, 8, to the outer wall of clamp limbs 5, 6. In this way, the effective wall thickness $W_S$ of the insulation-piercing connection 4 decreases from the base 38 of the U upwards in the direction towards the cutting edges 7, 8. The effective wall thickness $W_S$ thus tapers from the base 38 of the U of insulation-piercing connection 4 in the direction towards the cutting edges 7, 8.

Figure 14:
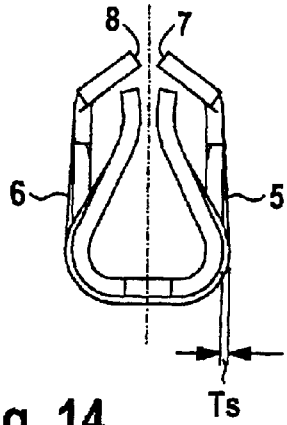
FIG. 14 is a top plan view of a rear end face of the insulation-piercing connection according to FIG. 10.

Finally, FIG. 14 shows a top view of the rear end face of the insulation-piercing connection 4. Here as well, it is clear that the bead depth $T_S$ of the bead 36, and thus also the effective wall thickness (see FIG. 12), decreases as it moves upward.

We claim:

1. A screwless connecting terminal, comprising:

a terminal housing having a housing lead-through formed therein;

a conductor tail disposed in said terminal housing;

an insulation-piercing connection connected in an electrically conductive fashion with said conductor rail, said insulation-piercing connection having clamp limbs with cutting edges facing one another for receiving and contacting an electrical conductor introduced into said terminal housing through said housing lead-through, an insulation-piercing contacting of the electrical conductor immovably positioned in said terminal housing taking place through a translational movement of said insulation-piercing connection along said conductor rail in a longitudinal direction of said conductor rail; and at least one bead formed in and reinforcing at least one of said clamp limbs.

2. The connecting terminal according to claim 1, wherein said insulation-piercing connection has a U-shaped cross-section with two limbs forming said clamp limbs, and said at least one bead is formed into each of said clamp limbs.

3. The connecting terminal according to claim 1, wherein said at least one bead is one of a plurality of beads formed into said clamp limbs and disposed opposite one another.

4. The connecting terminal according to claim 1, wherein said bead goes around in a manner such that it likewise has a cross-sectional shape of a U.

5. The connecting terminal according to claim 1, wherein said at least one bead is one of a plurality of beads disposed alongside one another in relation to a center longitudinal axis of said insulation-piercing connection.

6. The connecting terminal according to claim 1, wherein said bead has a given thickness decreasing continuously in a direction towards said cutting edges of said clamp limbs, in such a way that an effective wall thickness of said insulation-piercing connection tapers in the direction towards said cutting edges.

7. The connecting terminal according to claim 1, wherein said bead is convexly curved outward.

8. The connecting terminal according to claim 1, wherein said bead is concavely curved inward.

9. The screwless connecting terminal according to claim 1, wherein the screwless connecting terminal is a modular terminal.

* * * * *